United States Patent [19]

Vacanti et al.

[11] Patent Number: 4,559,489

[45] Date of Patent: Dec. 17, 1985

[54] LOW-LOSS RADIO FREQUENCY MULTIPLE PORT VARIABLE POWER CONTROLLER

[75] Inventors: David C. Vacanti, Renton; John C. Read, Seattle; Jimmy S. Takeuchi, Mercer Island, all of Wash.

[73] Assignee: The Boeing Company, Seattle, Wash.

[21] Appl. No.: 537,696

[22] Filed: Sep. 30, 1983

[51] Int. Cl.[4] ..... H01P 5/12

[52] U.S. Cl. ..... 333/1.1; 333/116; 333/128

[58] Field of Search ..... 333/1.1, 127, 128, 136, 333/116

[56] References Cited

U.S. PATENT DOCUMENTS

| | | |
|---|---|---|
| 3,305,797 | 2/1967 | Clavin . |
| 3,400,342 | 9/1968 | Putnam . |
| 3,422,378 | 1/1969 | La Rosa . |
| 3,422,438 | 1/1969 | Marston . |
| 3,423,699 | 1/1969 | Hines . |
| 3,477,028 | 11/1969 | Aslaksen . |
| 3,479,615 | 11/1969 | Garver . |
| 3,506,930 | 4/1970 | Gantick . |
| 3,555,447 | 1/1971 | Bonfeld et al. . |
| 3,571,762 | 3/1971 | Smilen ..... 333/116 |
| 3,571,765 | 3/1971 | Friedman . |
| 3,646,467 | 2/1972 | Smith . |
| 3,676,803 | 7/1972 | Simmons . |
| 3,768,045 | 10/1973 | Chung . |
| 3,769,610 | 10/1973 | Savarin et al. . |
| 3,909,751 | 9/1975 | Tang et al. . |
| 3,928,806 | 12/1975 | Carter et al. . |
| 3,986,147 | 10/1976 | Carter et al. . |
| 4,004,255 | 1/1977 | Chapnikoff . |
| 4,028,632 | 6/1977 | Carter et al. . |
| 4,205,282 | 5/1980 | Gipprich . |
| 4,288,763 | 9/1981 | Hopfer . |
| 4,301,432 | 11/1981 | Carlson et al. . |

FOREIGN PATENT DOCUMENTS

| | | |
|---|---|---|
| 55-83314 | 6/1980 | Japan . |
| 708441 | 1/1980 | U.S.S.R. . |

*Primary Examiner*—Paul Gensler

*Attorney, Agent, or Firm*—Finnegan, Henderson, Farabow, Garrett & Dunner

[57] ABSTRACT

A multi-port power controller uses remote-controllable variable reactive elements to set the amount of power delivered to the ports.

12 Claims, 5 Drawing Figures

LOW-LOSS RADIO FREQUENCY MULTIPLE PORT VARIABLE POWER CONTROLLER

BACKGROUND OF THE INVENTION

This invention relates to the field of power dividers and, more specifically, to the use of such dividers with radio frequency (RF) power sources.

Power control systems which deliver input RF power to several output ports are typically very lossy. Many of such systems use transformers and transmission lines coupled to absorptive attenuators. Unfortunately, these systems do not deliver a large amount of their input power to their output ports, so such systems are not power efficient. Furthermore, many of these systems deliver power to output ports which have been turned off, which wastes power and makes it unavailable for other output ports.

For example, U.S. Pat. Nos. 4,028,632, 3,986,147 and 3,928,804 to Carter et al describe systems having an N-port circulator and isomismatch devices. The impedance mismatches, however, are fixed impedance transmission line mismatches and are not remote-controllable.

One of the objects of this invention is a highly efficient power controller which delivers virtually all of the input RF power to its output ports.

It is also an object of this invention to have a power efficient power controller which can be connected to a variable number of output ports.

Another object of this invention is a power controller which delivers power to several output ports and which can be easily adjusted to deliver no power to output ports that are turned off.

Yet another object of this invention is an efficient power controller which allows easy adjustment of the amount of power switched to any of its output ports.

Additional objects and advantages of this invention are set forth in the description which follows and in part would be obvious from that description or may be learned by practice of the invention. The objects and advantages of this invention may be realized by the apparatus pointed out in the appended claims.

SUMMARY OF THE INVENTION

The power controller of this invention uses variable reactive elements in its power distribution circuitry to deliver virtually all of the input power to the output ports. By using variable reactive elements, the amount of power delivered to any output port can be easily adjusted. If an output port is turned off, the power distribution circuitry can be adjusted to deliver virtually no power to that port.

The total power from the input (less insertion loss) source is always available to those ports which are still active. Virtually none of the power is absorbed at the off ports and the total power available may be apportioned as desired to the active ports.

To achieve the objects and in accordance with the purpose of this invention, as embodied and as described below, the power controller of this invention comprises a source of input power; a plurality of power output ports; and a first number of power distribution means coupled to the input power source and the power output ports for delivering substantially all of the input power to the plurality of output ports, each of the power distribution means receiving a fraction of input power, selectively transmitting a portion of that fraction of the input power to the output ports coupled to that power distribution means, and reflecting out the portion of the fraction of input power not transmitted to its coupled output ports.

More specifically, a power controller according to this invention for selectively distributing power supplied by a power source to n (where n is greater than one) output ports comprises n−1 circulators connected in series between the power source and an nth output port; and n−1 variable reflection coefficient devices each associated with and connected to a different one of the circulators and to a different one of the output ports, each of the variable reflection coefficient devices receiving input power from its associated circulator, transmitting a selective portion of the received input power to its associated output port, and reflecting back to its associated circulator the portion of the received input power not transmitted to its associated output port.

The accompanying drawings, which are incorporated in and which form a part of the specification, illustrate embodiments of the invention and, together with the description, explain the principles of the invention.

DESCRIPTION OF THE PREFERRED EMBODIMENT

Figure 1:
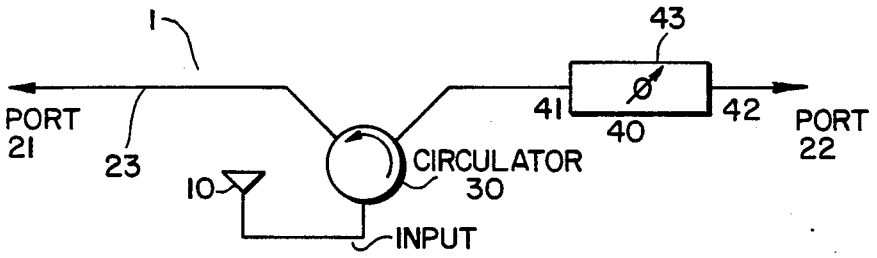
FIG. 1 shows an embodiment of a power controller of this invention for supplying input power to two output ports.

FIG. 1 shows a power controller 1 according to this invention which supplies input power from an RF input port 10 to output ports 21 and 22. In accordance with the present invention, the power controller includes a first number of power distribution means coupled to a source of input power and to power output ports for delivering substantially all of the input power to the output ports. Each of the power distribution means receives a fraction of input power, selectively transmits a variable portion of that fraction of input power to the power output ports coupled to that power distribution means, and reflects out the portion of the received fraction of input power not transmitted to its coupled output ports. In power controller 1 shown in FIG. 1, circulator 30 and variable reflection coefficient device 40 receive input power from RF input port 10, transmit a portion of that power to output port 22, and reflect out to the output port 21 via a power distribution line 23 the portion of the input power not transmitted to output port 22.

Circulator 30 is a conventional three terminal circulator. It sends the RF power from RF input port 10 into input/output terminal 41 of variable reflection coefficient device 40. It also sends to output port 21 via the power distribution line 23 any reflected power received from device 40 via input/output terminal 41.

The present invention also includes means for setting a reflection coefficient between zero and one to indicate the portion of power to be transmitted to the associated output port. Variable reflection coefficient device 40 has a set terminal 43 which is used to adjust the transmission coefficient r, or alternatively the reflection coefficient $1-r$, of device 40 to a value between zero and one. The transmission coefficient r indicates what portion of the power received from input port 10 will be transmitted to output port 22, while the reflection coefficient $1-r$ indicates what portion of the RF input power is reflected back through circulator 40. For example, when $r=0.1$, only one tenth of the input power is transmitted to output port 22 and nine-tenths of that power is reflected.

Since the portion of the input power which is not transmitted to the output port is reflected back out to circulator 32 and to output port 21, virtually all of the input power from RF input port 10 is divided between output ports 21 and 22. By adjusting set terminal 43, the portions of the input power outputted to ports 21 and 22 can be adjusted. If output port 22 is turned off, for example, then r of device 40 can be set to zero so virtually all of the input power will be delivered to output port 21.

Figure 2:
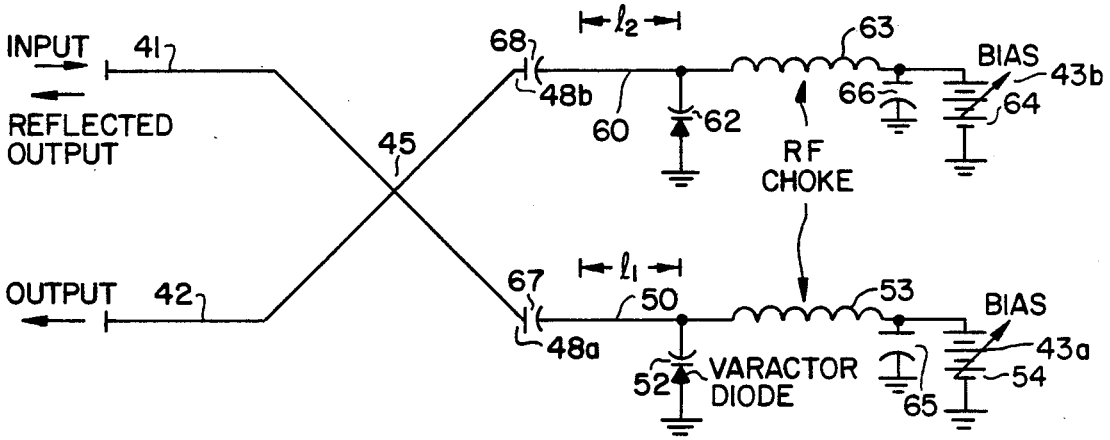
FIGS. 2 and *2a* show variable reflection coefficient devices which can be used with the power controller shown in FIG. 1.
Figure 3:
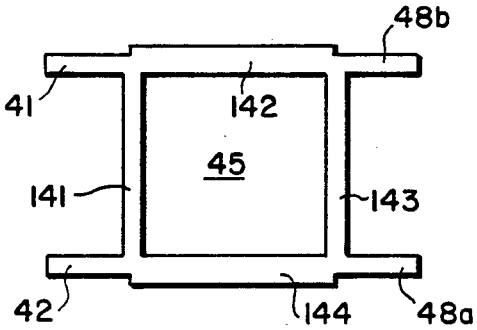
FIG. 3 shows a branch line coupler which can be used with the varable reflection coefficient device shown in FIG. 2.

An embodiment of the variable reflection coefficient device 40 is shown in greater detail in FIG. 2. Device 40 includes a branch line coupler circuit 45, an example of which is shown in FIG. 3. Branch line coupler circuit 45 in FIG. 3 is a microstrip circuit which includes two horizontal legs 142 and 144 and two vertical legs 141 and 143 connected to form a square. The width of the horizontal legs and of the vertical legs are different. For example, for the 3 db coupler required for circuit 45, the series impedance should be 35.35 ohms and the shunt impedance should be 50 ohms. So in this case is also assumed to be 50 ohms. For a microstrip circuit in a circuit board whose dielectric constant is 2.2 and thickness is 0.010 inches, a 50 ohm line is 0.031 inches wide and a 35 ohm line is 0.053 inches wide. The length of these lines is $\frac{1}{4}$ of the center operating frequency wavelength.

Alternatively, branch line coupler circuit 45 could include a waveguide or a coaxial circuit.

In FIGS. 2 and 3, input/output terminal 41 is shown in the upper left hand corner of device 40 and the output terminal 42 is shown at the lower left hand corner of device 40. Without any external circuitry, branch line coupler circuit 45 would divide the input power received at terminal 41 such that half of the power would appear at the upper right hand corner of circuit 45 and half the power would appear at that circuit's lower right hand corner. By adding reactive components to the upper and lower right hand corners of circuit 45, the amount of input power transmitted to output terminal 42 and reflected out of input/output terminal 41 can be adjusted.

In FIG. 2, the lower and upper right hand corners are denoted as 48*a* and 48*b*, respectively. In accordance with the present invention the power controller of this invention includes a variable reactive means coupled to the branch line coupler circuit. In FIG. 2, a transmission line 50 of length $l_1$ and varactor diode 52 are coupled to terminal 48*a*. Similarly, transmission line 60 of length $l_2$ and varactor diode 62 are coupled to terminal 48*b*. The length of transmission lines $l_1$ and $l_2$ can have the same or different lengths depending upon the application.

Varactor diodes 52 and 62 provide a variable capacitance at RF frequencies. Each varactor diode and transmission line combination provide a specific reactance for the variable reflection coefficient device 40. The value of the reactance provided at terminals 48*a* and 48*b* determines the value of r for device 40.

The value of the reflection coefficient seen at terminals 48*a* & *b* is proportional to impedance mismatch between the hybrid transmission line impedance and the impedance of the reactance element at the operating frequency. For example if the impedance at 48*a* is 50 Ω(Z MIN) and the impedance at the end of $l_1$ was 70 Ω(Z MAX) the reflection coefficient can be calculated by:

$$\frac{\frac{Z\,MAX}{Z\,MIN}-1}{\frac{Z\,MAX}{Z\,MIN}+1}\ 1-r\ \text{(reflection coefficient)}$$

For this example $1-r=0.167$.

The lengths of transmission lines $l_1$ and $l_2$ have the property of altering the actual impedance seen at the output ports 48*a* & *b* due to the varactor diode. These transmission line lengths and their characteristic impedance alter the limited impedance range of the varactor diode and transform this into the desired values to achieve high and low levels of reflection coefficients.

The operation of elements 50–54 will be described with the understanding that elements 60–64 behave analogously. A voltage variable capacitance device, such as the varactor diode 52 has a capacitance that is determined by the voltage across that diode. To set that voltage, RF choke 53 and a variable power supply 54 are connected to the junction of varactor diode and transmission line 50.

Typically, RF choke 53 is a transmission line which is one or two times narrower than transmission line 50. RF choke 53 isolates the RF signals from power supply 54 because it appears as a very high impedance to RF frequency signals. To the constant voltage signals from power supply 54, however, choke 53 appears as a very low impedance, hence the bias voltage from supply 54 can pass through choke 53 to a set the capacitance of varactor diode 52.

To provide an even higher impedance for the input RF power, the length of RF choke 53 is set to about $\frac{1}{4}$ of the wave length of the RF power and the RF choke is connected to the power supply by large printed circuit board capacitors (65, 66) to ground which act as low impedance at RF frequencies.

Figure 2A:
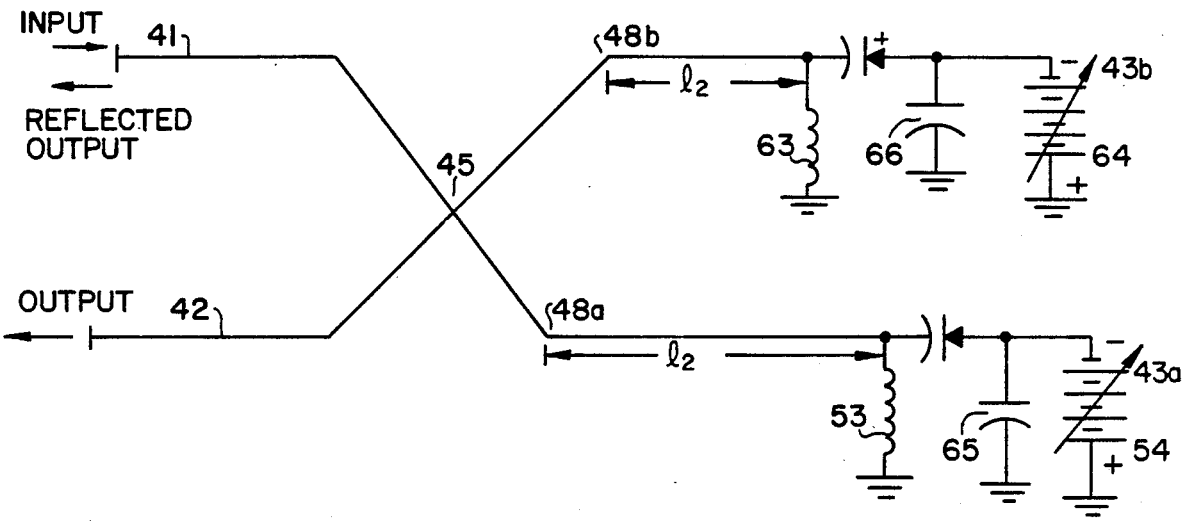

The capacitance of DC blocking capacitors 67 and 68 is chosen to be large at the RF operating frequencies so that they contribute an insignificant reactance or impedance in the circuit. Alternatively, DC blocking capacitors 65 and 66 may be removed if RF chokes 53 and 63 are moved directly to the left of varactor diodes 62 and 52 and connected across those diodes as in FIG. 2*a*.

The voltage of power supply 54 is set via terminal 43*a* just as the voltage of power supply 64 is set by terminal 43*b*. Preferably, terminals 43*a* and 43*b* are electronically controlled for speed and convenience. Terminals 43*a* and 43*b* together form set terminal 43 in FIG. 2.

For example, if the varactor diodes 52 and 62 are set to 1 picofarad, reactance of a 1 picofarad capacitor at 100 Megahertz operating frequency is computed by:

$$X_c = \frac{1}{2\pi FC} \text{ where}$$

$$\pi = 3.14159$$

$$F = 100 \times 10^6$$

$$C = .1 \times 10^{-12}$$

$$X_c = 1.59 \times 10^3 \text{ OHMS}$$

The reflection Coefficient due to this reactance is computed if for example the impedance at 48*a* is 50 ohms.

$$1 - r = \frac{\frac{Z\,MAX}{Z\,MIN} - 1}{\frac{Z\,MAX}{Z\,MIN} + 1} = \frac{\frac{1590}{50} - 1}{\frac{1590}{50} + 1} = .939$$

Figure 4:
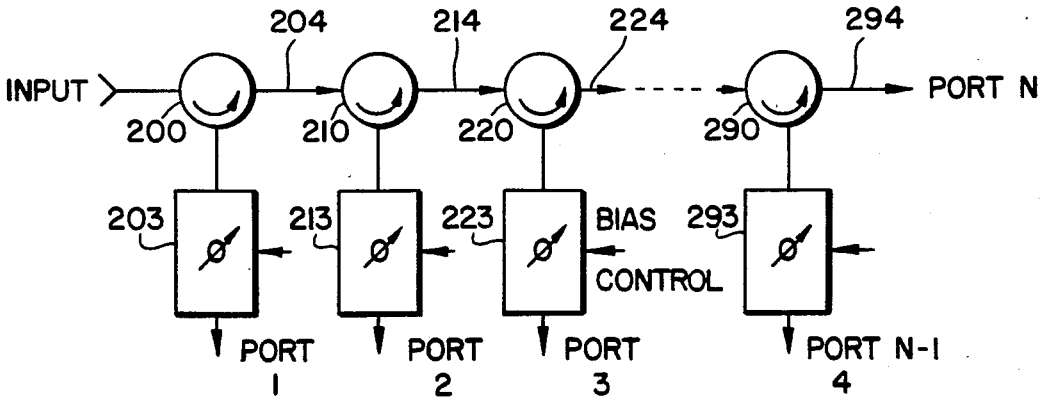
FIG. 4 shows an embodiment of a power controller of this invention for supplying input power to several output ports.

FIG. 4 shows an embodiment of the present invention to divide input power for N output ports. A circulator and a variable reflection coefficient device correspond to all but output port N. Specifically, output port 1 corresponds to circulator 200 and variable reflection coefficient device 203, output port 2 corresponds to circulator 210 and variable reflection coefficient device 213, output port 3 corresponds to circulator 220 and variable reflection coefficient device 223, and output port N-1 corresponds to circulator 290 and variable reflection coefficient device 293. Output port N does not correspond to a circulator and variable reflection coefficient device, but N is coupled to circulator 290 and receives that portion of the input power which is not sent to any of the other output ports.

Circulators 200, 210, 220 and 290 function similarly to circulator 30 in that power input to a circulator is sent to the associated variable reflection coefficient device. That variable reflection coefficient device reflects certain of that power back to the circulator which then transmits that power via power distribution lines 204, 214, 224 and 294 to the next circulator or, in the case of circulator 290, to output port N.

The input voltage from RF input 10 is sent via circulator 200 to variable reflection coefficient device 203 having a transmission coefficient, $r_1$. The voltage output to port 1 equals $r_1$ times the input voltage and the voltage reflected back through circulator 200 and into circulator 210 equals $(1-r_1)$ times the input voltage. Circulator 210 delivers that reflected power into device 213 which has a transmission coefficient of $r_2$. Thus, output port 2 receives $r_2$ of its incident input voltage or $r_2{}^x(1-r_1)$ times the input voltage to the controller.

If $r_1$ and $r_2$ equaled $\frac{1}{2}$, output port 1 would receive $\frac{1}{2}$ of the RF input voltage and output port 2 would receive $\frac{1}{4}$ that input voltage. The amount of voltage reflected into circulator 220 is also equal to $\frac{1}{4}$ the input voltage.

The other variable reflection coefficient devices similarly split the power input to them between their output ports and the following circulator according to their reflection coefficients. The power reflected by variable reflection coefficient device 293 is output to port N.

What is claimed is:

1. A power control comprising:

a single input power port;

a plurality of power output ports;

power distribution means coupled to said input power port and to said power output ports for delivering substantially all of the input power applied to said input port to said plurality of output ports, said power distribution means receiving all of said input power, selectively transmitting a variable portion of said input power to one of the output ports coupled to the power distribution means, and reflecting out the portion of said input power not transmitted to said one output port; said power distribution means including a circulator, a variable reflection coefficient device, and a power distribution line operatively coupling said circulator to another of said power output ports;

said variable reflection coefficient device having a main terminal for receiving said input power and an output terminal for transmitting out a variable portion of said amount of input power to said one power output port; said variable reflection coefficient device having a voltage variable capacitance for setting the reflection coefficient of said variable reflection coefficient device at any desired value between 0 and 1 to control the proportion of said input power to be reflected back out to said main terminal and the portion of said input power to be transmitted from said output terminal; and means for selecting the portion of input power transmitted to said output terminal, including electronically controlled power supply means for providing a variable voltage bias to said voltage variable capacitance; said variable reflection coefficient device further including a branch line coupler circuit having an input/output terminal connected to the device's associated circulator via said main terminal, and an output terminal connected to the device's associated output terminal; and wherein said voltage variable capacitance is associated with and coupled to said branch line coupler circuit and causes the branch line coupler circuit to couple a selected portion of the power received by its input/output terminal to its output terminal and to reflect out of its input/output terminal the portion of the received input power which is not coupled to said output terminal;

said circulator having an input terminal receiving said input power applied thereto from said input power port, an input/output terminal coupled to said main terminal of said variable reflection coefficient device, and an output terminal for transmitting the power reflected out from said variable reflection coefficient device into said circulator input/output terminal, thence to said power distribution line.

2. A power controller according to claim 1 wherein said voltage variable capacitance comprises a varactor diode.

3. A power controller according to claim 2 wherein said power distribution means includes a plurality of said circulators and a plurality of variable reflection coefficient devices coupled one each to said circulators, each of said circulators being connected in series such that the input terminal of all but a first one of said circulators is coupled via said power distribution line to the output terminal of a different circulator, and the input terminal of said first circulator is coupled to said source of input power.

4. A power controller for selectively distributing input power supplied to an input power port by a power source to n (where n is an integer greater than 2) output power ports, said controller comprising:

n−1 circulators connected in series between said input port and an nth output port;

n − 1 variable reflection coefficient devices, one each associated with and connected to one each of said circulators and to one each of said output ports, each of said variable reflection coefficient devices receiving input power from its associated circulator, transmitting a selected portion of said input power to its associated output port, and reflecting back to its associated circulator a portion of its received input power not transmitted to its associated output power port, each of said variable reflection coefficient devices including a voltage variable capacitance for setting a reflection coefficient at any desired value between 0 and 1 to control the portion of power to be transmitted to the associated output power port, and an electronically controllable power supply for providing a variable voltage bias to said voltage variable capacitance; each of said variable reflection coefficient devices further including a branch line coupler circuit having an input/output terminal connected to the device's associated circulator, and an output terminal connected to the device's associated output power port; and wherein said voltage variable capacitance of each variable reflection coefficient device is associated with and coupled to the branch line coupler circuit in the same device and causes that branch line coupler circuit to couple a selected portion of the power received by its input/output terminal to its output terminal and to reflect out from its input/output terminal the portion of the received input power which is not coupled to said output terminal;

each of said circulators including an input port for receiving input power, and input/output port for transmitting said input power to and receiving reflected power from its associated variable reflection device, and an output port for outputting the reflected power received by said input/output port, and wherein the input port of all of said circulators except a first circulator is coupled to the output port of a different circulator and wherein the input port of said first circulator is coupled to said input power port, and the output port or the (n − 1)th circulator is coupled to the nth output power port.

5. A power controller according to claim 4 wherein said voltage variable capacitance includes a varactor diode.

6. A power controller according to claim 4 wherein each of said branch line coupler circuits includes a microstrip circuit.

7. A power controller according to claim 4 wherein each of said branch line coupler circuits includes a strip line branch-line coupler circuit.

8. A power controller according to claim 4 wherein each of said variable reflection coefficient devices includes two set terminals coupled to said electrically controllable power supply and wherein said voltage variable capacitance includes two varactor diodes and two transmission lines coupling one each varactor diode to each set terminal.

9. A power controller according to claim 8 further comprising an RF choke in series with said electronically controllable power supply.

10. A power controller according to claim 8 further comprising an RF choke connected across each said varactor diode.

11. A power controller according to claim 8 wherein each of said transmission lines has the same length.

12. A power controller according to claim 8 wherein each of said transmission lines has a different length.

* * * * *